US008306249B2

(12) United States Patent
Rosenkranz

(10) Patent No.: US 8,306,249 B2
(45) Date of Patent: Nov. 6, 2012

(54) METHOD AND ACOUSTIC SIGNAL PROCESSING DEVICE FOR ESTIMATING LINEAR PREDICTIVE CODING COEFFICIENTS

(75) Inventor: Tobias Rosenkranz, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 337 days.

(21) Appl. No.: 12/748,565

(22) Filed: Mar. 29, 2010

(65) Prior Publication Data

US 2010/0266152 A1 Oct. 21, 2010

(30) Foreign Application Priority Data

Apr. 21, 2009 (EP) ..... 09005597

(51) Int. Cl.
*H04R 25/00* (2006.01)

(52) U.S. Cl. ..... 381/317

(58) Field of Classification Search ..... 381/317
See application file for complete search history.

(56) References Cited

U.S. PATENT DOCUMENTS

| | | | | |
|---|---|---|---|---|
| 5,953,697 | A * | 9/1999 | Lin et al. | 704/225 |
| 5,966,689 | A * | 10/1999 | McCree | 704/226 |
| 6,009,388 | A * | 12/1999 | Ozawa | 704/223 |
| 6,182,030 | B1 * | 1/2001 | Hagen et al. | 704/201 |
| 6,226,607 | B1 * | 5/2001 | Chang et al. | 704/221 |
| 6,385,578 | B1 * | 5/2002 | Lee et al. | 704/225 |
| 6,732,070 | B1 * | 5/2004 | Rotola-Pukkila et al. | 704/219 |
| 6,807,527 | B1 * | 10/2004 | Rozhdestvenskij et al. | 704/223 |
| 7,587,316 | B2 * | 9/2009 | Morii | 704/226 |
| 8,116,490 | B2 * | 2/2012 | Puder et al. | 381/318 |
| 2001/0053229 | A1 * | 12/2001 | Azizi | 381/94.1 |
| 2002/0176594 | A1 * | 11/2002 | Hohmann et al. | 381/312 |
| 2004/0023677 | A1 * | 2/2004 | Mano et al. | 455/500 |
| 2007/0124140 | A1 * | 5/2007 | Iser et al. | 704/223 |

OTHER PUBLICATIONS

Srinivasan, et al., "Codebook Driven Short-Term Predictor Parameter Estimation for Speech Enhancement", IEEE Transactions on Audio, Speech, and Language Processing, Jan. 2006, pp. 163-176, vol. 14, No. 1.

Srinivasan, et al., "Codebook-Based Bayesian Speech Enhancement for Nonstationary Environments", IEEE Transactions on Audio, Speech, and Language Processing, Feb. 2007, pp. 441-452, vol. 15, No. 2.

* cited by examiner

*Primary Examiner* — Forrest M Phillips
(74) *Attorney, Agent, or Firm* — Laurence A. Greenberg; Werner H. Stemer; Ralph E. Locher

(57) ABSTRACT

A method and an appropriate acoustic signal processing device estimate a set of linear predictive coding coefficients of a microphone signal using minimum mean-square error estimation with a codebook containing several predetermined sets of linear predictive coding coefficients. The method includes determining sums of weighted backward transition probabilities describing the transition probabilities between the predetermined sets of linear predictive coding coefficients. The backward transition probabilities are obtained from signal training data by mapping the signal training data to one set of the codebook and by determining relative frequencies of transitions between two of the sets of the codebook. Modelling the "memory" of the codebook has the advantage that the accuracy of estimating linear predictive coding coefficients is increased considerably also for speech components.

13 Claims, 2 Drawing Sheets

METHOD AND ACOUSTIC SIGNAL PROCESSING DEVICE FOR ESTIMATING LINEAR PREDICTIVE CODING COEFFICIENTS

CROSS-REFERENCE TO RELATED APPLICATION

This application claims the priority, under 35 U.S.C. §119, of European application EP 09005597, filed Apr. 21, 2009; the prior application is herewith incorporated by reference in its entirety.

BACKGROUND OF THE INVENTION

Field of The Invention

The present invention relates to a method, an acoustic signal processing device and a use of an acoustic processing device for estimating linear predictive coding coefficients.

In signal enhancement tasks, adaptive Wiener filtering is often used to suppress background noise and interfering sources. For constructing a Wiener filter it is necessary to have at least an estimate of the noise power spectral density (PSD). Conventional speech enhancement systems typically rely on the assumption that the noise is rather stationary, i.e., its characteristics change very slowly over time. Therefore, noise characteristics can be estimated during speech pauses but requiring a robust speech activity detection (VAD). More sophisticated methods are able to update the noise estimate even during speech activity and thus do not require a VAD. This is performed by decomposing the noisy speech into sub-bands and tracking minima in these sub-bands over a certain time interval. Because of the higher dynamics of the speech signal the minima should correspond to the noise PSD if the noise is sufficiently stationary. However, this method fails if the noise characteristics exceed a certain degree of non-stationarity and thus the performance in highly non-stationary environments (e.g., babble noise in a cafeteria) breaks down severely.

More recently, model-based speech enhancement methods have emerged that utilize a priori knowledge about speech and noise. In the reference by S. Srinivasan, titled "Codebook Driven Short-Term Predictor Parameter Estimation for Speech Enhancement", IEEE Trans. Audio, Speech, and Language Process., vol. 14, no. 1, January 2006, pp. 163-176 one of these methods is described in detail. The main idea disclosed is to estimate linear predictive coding (LPC) coefficients, i.e., prediction coefficients and excitation variances (gains) of speech and noise from the noisy signal. The LPC coefficients directly correspond to spectral envelopes of the speech and noise signal parts. For distinguishing between speech and noise, trained codebooks are used that contain typical sets of prediction coefficients (i.e., typical spectral envelopes) of speech and noise.

The estimation method involves building every possible pair of speech and noise parameter sets taken from the respective codebooks and computing the optimum gains so that the sum of the LPC spectra of speech and noise fits best to the observed noisy spectrum. The proposed criterion is the Itakura-Saito distance between the sum of the LPC spectra and the observed noisy spectrum. The Itakura-Saito distance has shown a good correlation with human perception. The codebook combination with the respective gains that globally minimizes the Itakura-Saito distance is considered as the best estimate. With the corresponding LPC spectra a Wiener filter for noise reduction is constructed. It is disclosed that minimizing the Itakura-Saito distance results in the maximum likelihood (ML) estimate of the speech and noise parameters. The disclosed method has the advantage of enhancing every signal frame independently and thus it is able to react instantaneously to noise fluctuations. Therefore it can deal with highly non-stationary noise.

Besides the ML method, a minimum mean-square error (MMSE) approach has been disclosed in the reference by S. Srinivasan, titled "Codebook-Based Bayesian Speech Enhancement for Nonstationary Environments", IEEE Trans. Audio, Speech, and Language Process., vol. 15, no. 2, February 2007, pp. 441-452. The parameter estimates are not single codebook entries anymore but a weighted sum of all possible combinations of codebook entries with the weights being proportional to the probability that the codebook entry combination corresponds to the observed noisy signal. This probability is called the likelihood and is denoted as $p(x|\theta)$, where x denotes a frame of noisy speech samples and $\theta$ is a vector containing the speech and noise LPC parameters. It is further disclosed that incorporating memory improves the estimation accuracy.

Memory is incorporated in the form of conditional probabilities and the weights are proportional to $$p(x|\theta)p(\hat{\theta}_{s,k-1}|\theta_s)p(\hat{\theta})_{n,k-1}|\theta_n). \tag{1}$$

$\theta_s$ and $\theta_n$ denote the LPC parameters (without the gains) of speech and noise of the current frame. $\hat{\theta}_{s,k-1}$ and $\hat{\theta}_{n,k-1}$ are the estimates of the respective parameters from the preceding frame. By applying suitable models for the conditional probabilities $p(\hat{\theta}_{s,k-1}|\theta_s)$ and $p(\hat{\theta}_{n,k-1}|\theta_n)$ the estimation accuracy can be improved considerably because ambiguities arising from the Itakura-Saito-distance using as the only optimization criterion can be reduced.

The conditional probabilities $p(\hat{\theta}_{s,k-1}|\theta_s)$ and $p(\hat{\theta}_{n,k-1}|\theta_n)$ are modeled as multivariate Gaussian Random Walks N:

$$p(\hat{\theta}_{s,k-1}|\theta_s)\sim N(\hat{\theta}_{s,k-1},\Lambda_s)$$

$$p(\hat{\theta}_{n,k-1}|\theta_n)\sim N(\hat{\theta}_{n,k-1},\Lambda_n), \tag{2}$$

where $\Lambda_s$ and $\Lambda_n$ are diagonal matrices with variances on their diagonals that are estimated from training data. It is reported that using this model the estimation accuracy of the speech parameters is not or at least only very little affected.

SUMMARY OF THE INVENTION

It is accordingly an object of the invention to provide a method and an acoustic signal processing device for estimating linear predictive coding coefficients which overcome the above-mentioned disadvantages of the prior art methods and devices of this general type, which improves noise and speech estimations.

The invention claims a method for estimating a set of linear predictive coding coefficients of a microphone signal using minimum mean-square error estimation with a codebook containing several predetermined sets of linear predictive coding coefficients. The method includes determining sums of weighted backward transition probabilities describing the transition probabilities between the predetermined sets of linear predictive coding coefficients. The backward transition probabilities are obtained from signal training data by mapping the signal training data to one set of the codebook and by determining relative frequencies of transitions between two sets of the codebook. Modelling the "memory" of the system according to the invention has the advantage that the estimation accuracy is increased considerably also for speech components.

In a preferred embodiment the method can include weighting every backward transition probability with a first weight of the corresponding predetermined set of linear predictive coding coefficients determined at a preceding time instant.

In a further embodiment the method can include weighting the predetermined sets of linear predictive coding coefficients with the corresponding weighted sum of backward transition probabilities.

In a preferred embodiment the first weights can be a measure for the probability that the combination of predetermined sets of linear predictive coding coefficients may have produced the microphone signal.

In a further embodiment the method can include determining second weights for all predetermined sets of linear predictive coding coefficients for a current time frame. The second weights denote a measure for the probability that the combination of predetermined sets of linear predictive coding coefficients may have produced the microphone signal at the current time frame. The method can further include summing all predetermined sets of linear predictive coding coefficients weighted with the determined weighted transition probabilities and the determined second weights yielding the estimated set of linear predictive coding coefficients at the current time frame.

Furthermore the method can be carried out with a speech codebook and a noise codebook.

The invention also claims an acoustic signal processing device for estimating a set of linear predictive coding coefficients of a microphone signal using minimum mean-square error estimation with a codebook containing several predetermined sets of linear predictive coding coefficients. The device includes a signal processing unit which determines sums of weighted backward transition probabilities describing the transition probabilities between the predetermined sets of linear predictive coding coefficients. The backward transition probabilities are obtained from signal training data by mapping the signal training data to one set of the codebook and by determining relative frequencies of transitions between two sets of the codebook.

In a preferred embodiment every backward transition can be weighted with a first weight of the corresponding predetermined set of linear predictive coding coefficients determined at a preceding time instant.

Furthermore the predetermined sets of linear predictive coding coefficients can be weighted with the corresponding weighted sum of backward transition probabilities.

In a further embodiment the first weight can be a measure for the probability that the combination of the predetermined sets of linear predictive coding coefficients may have produced the microphone signal.

In a preferred embodiment second weights can be determined for all predetermined sets of linear predictive coding coefficients for a current time frame. The second weights denote a measure for the probability that the combination of the predetermined sets of linear predictive coding coefficients may have produced the microphone signal at the current time frame. All predetermined sets of linear predictive coding coefficients can be weighted with the determined weighted transition probabilities and the determined second weights and can be summed yielding the estimated set of linear predictive coding coefficients at the current time frame.

Finally, estimating a set of linear predictive coding coefficients can be carried out with a speech codebook and a noise codebook.

The invention also claims a use of an acoustic signal processing device according to the invention in a hearing aid. The invention provides the advantage of an improved noise reduction.

Other features which are considered as characteristic for the invention are set forth in the appended claims.

Although the invention is illustrated and described herein as embodied in a method and an acoustic signal processing device for estimating linear predictive coding coefficients, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
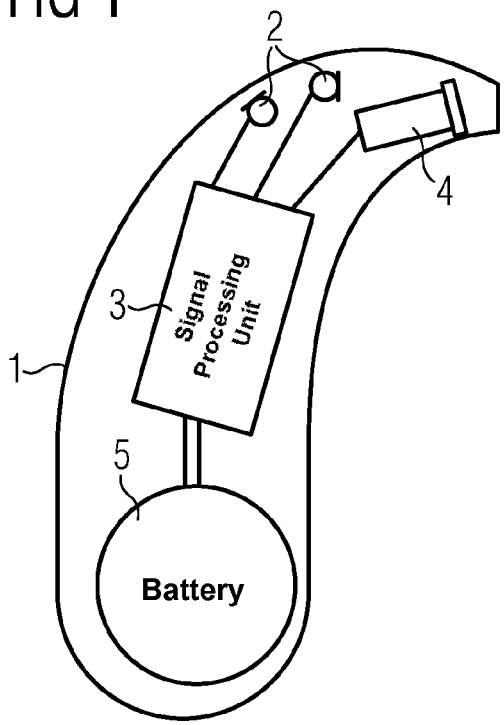
FIG. 1 is a diagrammatic illustration of a hearing aid according to the prior art.

Since the present application is preferably applicable to hearing aids, such devices shall be briefly introduced in the next two paragraphs together with FIG. 1.

Hearing aids are wearable hearing devices used for supplying hearing impaired persons. In order to comply with the numerous individual needs, different types of hearing aids, like behind-the-ear hearing aids and in-the-ear hearing aids, e.g. concha hearing aids or hearing aids completely in the canal, are provided. The hearing aids listed above as examples are worn at or behind the external ear or within the auditory canal. Furthermore, the market also provides bone conduction hearing aids, implantable or vibrotactile hearing aids. In these cases the affected hearing is stimulated either mechanically or electrically.

In principle, hearing aids have one or more input transducers, an amplifier and an output transducer as essential components. An input transducer usually is an acoustic receiver, e.g. a microphone, and/or an electromagnetic receiver, e.g. an induction coil. The output transducer normally is an electroacoustic transducer like a miniature speaker or an electromechanical transducer like a bone conduction transducer. The amplifier usually is integrated into a signal processing unit. Such principle structure is shown in FIG. 1 for the example of a behind-the-ear hearing aid. One or more microphones 2 for receiving sound from the surroundings are installed in a hearing aid housing 1 for wearing behind the ear. A signal processing unit 3 is also installed in the hearing aid housing 1 and processes and amplifies the signals from the microphone. The output signal of the signal processing unit 3 is transmitted to a receiver 4 for outputting an acoustical signal. Optionally, the sound will be transmitted to the ear drum of the hearing aid user via a sound tube fixed with an otoplastic in the auditory canal. The hearing aid and specifically the signal processing unit 3 are supplied with electrical power by a battery 5 also installed in the hearing aid housing 1.

The invention utilizes the MMSE estimation scheme described in the reference by S. Srinivasan, entitled "Codebook-Based Bayesian Speech Enhancement for Nonstationary Environments", IEEE Trans. Audio, Speech, and Language Process., vol. 15, no. 2, February 2007, pp. 441-452. However, a completely different model is used for the conditional probabilities $p(\hat{\theta}_{s,k-1}|\theta_s)$ and $p(\hat{\theta}_{n,k-1}|\theta_n)$. The invention is based on the fact that the temporal evolution of the prediction parameters can be modeled as a Markov chain. A Markov chain consists of a finite set of states, which are equal to codebook entries $\theta_s$, $\theta_n$ according to the invention, and transition probabilities between the states. Every codebook entry contains a set of LPC coefficients. The transition probabilities are obtained from training data by first mapping each frame of training data to one codebook entry and secondly computing the relative frequencies of transitions between two codebook entries (Markov states).

Figure 2:
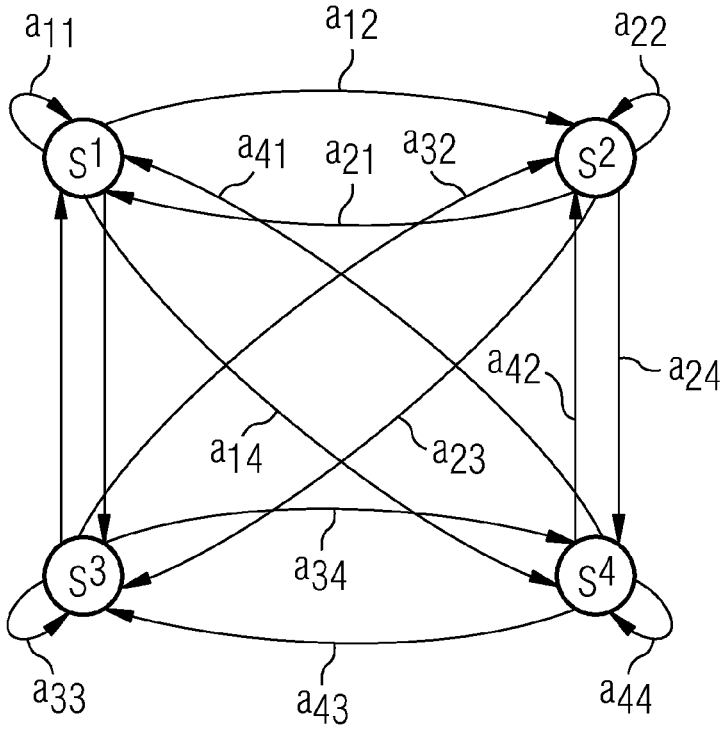
FIG. 2 is a diagram of an exemplary Markov chain.

FIG. 2 shows an exemplary Markov chain with four states $S^1$, $S^2$, $S^3$, $S^4$. Each state corresponds to one codebook entry. The transition probabilities between codebook entries $$a_{ij}=p(S_k^j|S_{k-1}^i) \tag{3}$$

can be converted to the backward transition probabilities $$b_{ij}=p(S_{k-1}^j|S_k^i) \tag{4}$$

via Bayes' rule. The backward transition probabilities $b_{ij}$ directly correspond to the conditional probabilities $p(\hat{\theta}_{s,k-1}=\theta_s^j)$ modeling the memory. Given that the state estimate, i.e., the estimate of the spectral envelope, at the preceding time instant was $$\hat{\theta}_{s,k-1}=\theta_s^j, \tag{5}$$

we get $$b_{ij}=p(\hat{\theta}_{s,k-1}|\theta_s^i) \tag{6}$$

and likewise for the noise. However, this only holds if the state estimate were uniquely defined by only one codebook entry.

In the MMSE estimation scheme, the state estimate is a weighted sum of all possible states, so the transition probabilities are a weighted sum of the backward transition probabilities $b_{ij}$, as well. In this case, the transition probabilities are computed as $$p(\hat{\theta}_{s,k-1}\,|\,\theta_s^i)=\sum_{j=1}^{N_s} w_{s,k-1}^j b_{ji}, \tag{7}$$

where the $w_{s,k-1}^j$ denote the weights of the states (i.e., the weights of the codebook entries) at the preceding time frame and $N_s$ denotes the number of (speech) codebook entries. Similar holds also for the noise.

Figure 3:
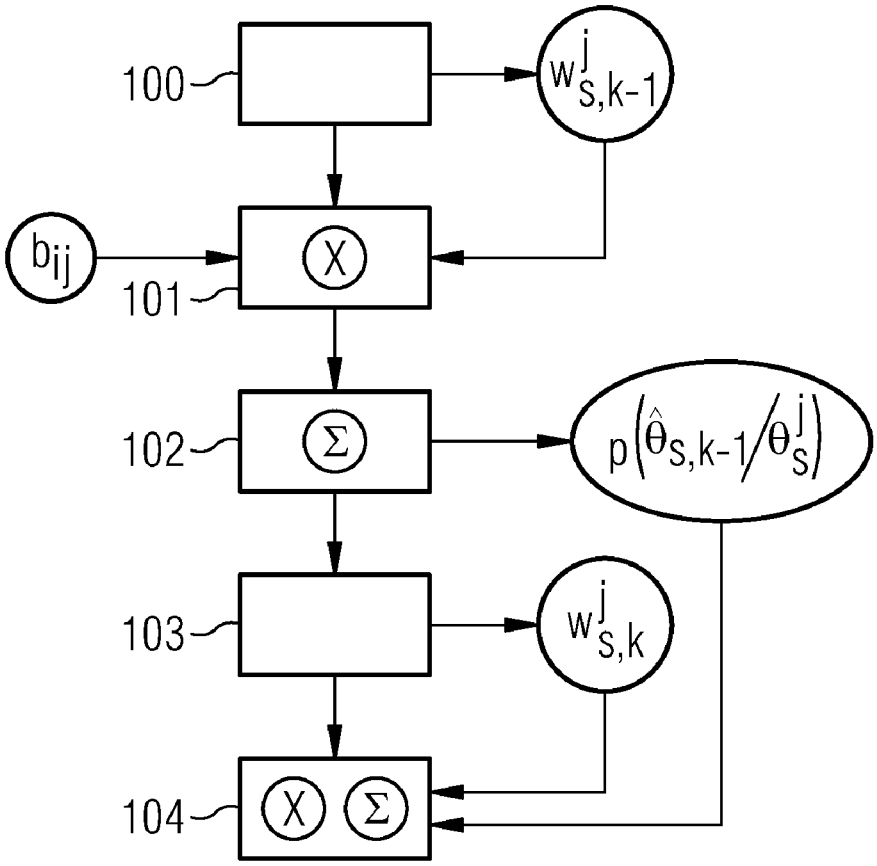
FIG. 3 is a flow chart of a method according to the invention.

FIG. 3 shows a flow chart of an embodiment of the method according to the invention for estimating a set $\hat{\theta}_{s,k}$ of linear predictive coding coefficients for speech for a current time frame k of a microphone signal. A speech codebook with $N_s$ sets $\theta_s^j$ predefined linear predictive coding coefficients with $j=1, \ldots, N_s$ is used.

In the first step 100 $N_s$ first weights $w_{s,k-1}^j$ for all codebook sets for the time frame k−1 which is the preceding time frame to time frame k are determined. The first weights $w_{s,k-1}^j$ denote a measure for the probability that a codebook set may may have produced the actual microphone signal at the preceding time frame k−1.

In step 101 the backward transition probabilities $b_{ij}$ between every pair of codebook sets $\theta_s^i$, $\theta_s^j$, are used to weight the $N_s$ weights $w_{s,k-1}^j$ determined in step 100. The backward transition probabilities $b_{ij}$ are obtained from signal training data by mapping the signal training data to one set of the codebook and by determining relative frequencies of transitions between two sets of the codebook.

In step 102 all $N_s$ weighted backward transition probabilities $b_{ij}$ are summed up for every $N_s$ codebook set $\theta_s^j$ resulting in $N_s$ transition probabilities $p(\hat{\theta}_{s,k-1}|\theta_s^i)$.

In step 103 $N_s$ second weights $w_{s,k}^j$ for all codebook sets $\theta_s^j$ for the current time frame k are determined. The second weights $w_{s,k}^j$ denote a measure for the probability that a codebook set $\theta_s^j$ may have produced the microphone signal at the current time frame k.

In the final step 104 sum of all $N_s$ codebook set $\theta_s^j$ weighted with the determined transition probabilities $p(\hat{\theta}_{s,k-1}|\theta_s^i)$ and the determined weights $w_{s,k}^j$ is calculated which yields the estimated set $\hat{\theta}_{s,k}$ of linear predictive coding coefficients for speech at the time frame k.

Figure 4:
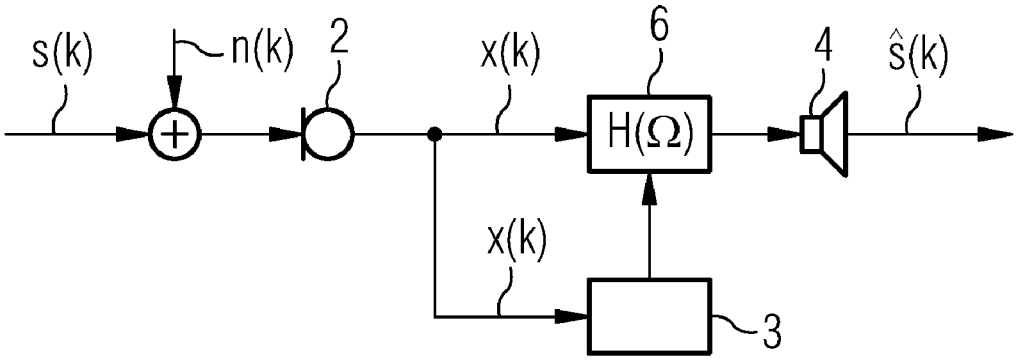
FIG. 4 is a block diagram of an acoustic processing system according to the invention.

FIG. 4 shows a block diagram of an acoustic processing device according to the invention with a microphone 2 for transforming acoustic signals s(k), n(k) into an electrical signal x(k) and a receiver for transforming an electrical signal into an acoustic signal ŝ(k). A clean speech signal s(k) is corrupted by additive colored and non-stationary noise n(k) according to $$x(k)=s(k)+n(k). \tag{7}$$

Speech and noise are assumed to be uncorrelated. With a filter h(k) an estimate ŝ(k) of the possibly time delayed clean speech signal can be obtained according to $$\hat{s}(k)=h(k)*x(k), \tag{8}$$

where "*" denotes linear convolution. The equivalent formulation in the frequency-domain reads $$\hat{S}(\Omega)=H(\Omega)\times X(\Omega). \tag{9}$$

The optimal solution to this problem in the minimum mean-squared error (MMSE) sense is the well known Wiener filter 6

$$H(\Omega)=\frac{S_{ss}(\Omega)}{S_{xx}(\Omega)}, \tag{10}$$

where $S_{ss}(\Omega)$ and $S_{xx}(\Omega)$ denote the auto power spectral densities (PSD) of the clean speech signal s(k) and the noisy microphone signal x(k), respectively.

In a real noise reduction scheme, $S_{ss}(\Omega)$ has to be estimated since only the noisy speech PSD $S_{xx}(\Omega)$ is accessible. However, in nearly all applications it is much easier to get an estimate of the noise PSD $S_{nn}(\Omega)$. Given the fact that speech and noise are assumed to be uncorrelated the speech PSD $S_{ss}(\Omega)$ can be expressed as the difference between $S_{xx}(\Omega)$ and $S_{nn}(\Omega)$ $$S_{ss}(\Omega)=S_{xx}(\Omega)-S_{nn}(\Omega) \tag{11}$$

that yields an alternative formulation of the Wiener filter 6

$$H(\Omega)=1-\frac{S_{nn}(\Omega)}{S_{xx}(\Omega)}. \tag{12}$$

Equation 12 shows that for building a Wiener filter 6 it is also sufficient to have an estimate of the noise PSD $S_{nn}(\Omega)$. So the noise reduction task can be reduced to the task of estimating the noise PSD $S_{nn}(\Omega)$.

In accordance with the invention the noise PSD $S_{nn}(\Omega)$ and/or the speech PSD $S_{ss}(\Omega)$ can be calculated by using estimated linear predictive coding coefficients $\hat{\theta}_{s,k}$, $\hat{\theta}_{n,k}$. Therefore, the Wiener filter 6 can be built by estimating the linear predictive coding coefficients $\hat{\theta}_{s,k}$, $\hat{\theta}_{n,k}$ according to the method described above. The estimation is performed in a signal processing unit 3.

Preferably, the acoustic processing device according to the invention is used in a hearing aid for reducing background noise and interfering sources.

The invention claimed is:

1. A method for estimating a set of linear predictive coding coefficients of a microphone signal using minimum mean-square error estimation with a codebook containing several predetermined sets of linear predictive coding coefficients, which comprises the steps of:

determining sums of weighted backward transition probabilities describing transition probabilities between the predetermined sets of linear predictive coding coefficients, the backward transition probabilities being obtained from signal training data by mapping the signal training data to one of the predetermined sets of the codebook and by determining relative frequencies of transitions between two of the predetermined sets of the codebook.

2. The method according to claim 1, which further comprises weighting every one of the backward transition probabilities with a first weight of a corresponding predetermined set of linear predictive coding coefficients determined at a preceding time instant.

3. The method according to claim 1, which further comprises weighting the predetermined sets of linear predictive coding coefficients with a corresponding weighted sum of the backward transition probabilities.

4. The method according to claim 2, wherein the first weights are a measure for a probability that the predetermined sets of linear predictive coding coefficients may have produced the microphone signal.

5. The method according to claim 2, which further comprises:

determining second weights for all of the predetermined sets of linear predictive coding coefficients for a current time frame, the second weights denoting a measure for a probability that the predetermined sets of linear predictive coding coefficients may have produced the microphone signal at the current time frame; and summing all of the predetermined sets of linear predictive coding coefficients weighting with determined weighted transition probabilities and the second weights yielding an estimated set of linear predictive coding coefficients at the current time frame.

6. The method according to claim 1, which further comprises carrying out the method with a speech codebook and a noise codebook.

7. An acoustic signal processing device for estimating a set of linear predictive coding coefficients of a microphone signal using minimum mean-square error estimation with a codebook containing several predetermined sets of linear predictive coding coefficients, the acoustic signal processing device comprising:

a signal processing unit for determining sums of weighted backward transition probabilities describing transition probabilities between the predetermined sets of linear predictive coding coefficients, the backward transition probabilities being obtained from signal training data by mapping the signal training data to one of the predetermined sets of the codebook and by determining relative frequencies of transitions between two of the predetermined sets of the codebook.

8. The acoustic signal processing device according to claim 7, wherein every one of the backward transition probabilities is weighted with a first weight of a corresponding one of the predetermined sets of linear predictive coding coefficients determined at a preceding time instant.

9. The acoustic signal processing device according to claim 7, wherein the predetermined sets of linear predictive coding coefficients are weighted with a corresponding one of the sums of the backward transition probabilities.

10. The acoustic signal processing device according to claim 8, wherein the first weights are a measure for a probability that the predetermined sets of linear predictive coding coefficients may have produced the microphone signal.

11. The acoustic signal processing device according to claim 7, wherein second weights for all of the determined sets of linear predictive coding coefficients for a current time frame are determined, the second weights denote a measure for a probability that the predetermined sets of linear predictive coding coefficients may have produced the microphone signal at the current time frame, and that all the predetermined sets of linear predictive coding coefficients are weighted with determined weighted transition probabilities and the second weights and are summed yielding an estimated set of linear predictive coding coefficients at the current time frame.

12. The acoustic signal processing device according to claim 11, wherein the estimated set of linear predictive coding coefficients is carried out with a speech codebook and a noise codebook.

13. A hearing aid, comprising:

an acoustic signal processing device for estimating a set of linear predictive coding coefficients of a microphone signal using minimum mean-square error estimation with a codebook containing several predetermined sets of linear predictive coding coefficients, said acoustic signal processing device having a signal processing unit for determining sums of weighted backward transition probabilities describing transition probabilities between the predetermined sets of linear predictive coding coefficients, the backward transition probabilities being obtained from signal training data by mapping the signal training data to one of the predetermined sets of the codebook and by determining relative frequencies of transitions between two of the predetermined sets of the codebook.

* * * * *